United States Patent [19]

Bogaczyk

[11] Patent Number: 4,557,407

[45] Date of Patent: Dec. 10, 1985

[54] PANTS HANGER

[76] Inventor: Stanley H. Bogaczyk, P.O. Box 276, Rochelle Park, N.J. 07662

[21] Appl. No.: 638,525

[22] Filed: Aug. 6, 1984

Related U.S. Application Data

[63] Continuation-in-part of Ser. No. 342,345, Jan. 25, 1982, abandoned.

[51] Int. Cl.[4] ..... A47J 51/14

[52] U.S. Cl. ..... 223/96; 211/89; 211/120

[58] Field of Search ..... 223/95, 96; 211/89, 211/120

[56] References Cited

U.S. PATENT DOCUMENTS

| | | | |
|---|---|---|---|
| 499,326 | 6/1893 | Masse | 211/120 |
| 620,260 | 2/1899 | Thorpe | 211/120 |
| 620,261 | 2/1899 | Thorpe | 211/120 |
| 707,192 | 8/1902 | Aiken | 211/120 |
| 853,527 | 5/1907 | Tye | 211/120 |
| 1,268,371 | 6/1918 | McDonald | 211/89 |
| 1,994,808 | 3/1935 | Carlson | 223/96 |
| 2,127,333 | 8/1938 | Hall | 223/96 |
| 2,492,325 | 12/1949 | Schroeder | 211/89 X |
| 2,900,118 | 8/1959 | Simon | 223/96 |
| 3,297,168 | 1/1967 | Fleming | 211/89 |
| 3,762,570 | 10/1973 | Tobin | 211/89 X |

FOREIGN PATENT DOCUMENTS

| | | | |
|---|---|---|---|
| 109878 | 2/1940 | Australia | 223/96 |

*Primary Examiner*—Robert R. Mackey

*Attorney, Agent, or Firm*—Laughlin & Markensohn

[57] ABSTRACT

The invention provides a multiple pants hanger for supporting a plurality of pairs of pants. The hanger includes a plurality of horizontally extending parallel bars each substantially wider than thick, means for securing the bars together in a spaced relationship so that at one end the bars are free and unconnected and so that slots are formed between each bar and an adjoining bar with the slot ends being open at the free ends of the bars. The inside adjoining faces of the bars on each side of one of the slots is essentially flat and lie in vertical planes so that the fabric of the legs of a pair of pants positioned in one of the slots is in frictional contact with the adjoining side faces of adjacent bars over substantially the full length and width thereof.

4 Claims, 9 Drawing Figures

A
B
C
42
42'
16'
14'
40
40'
12'
12''

PANTS HANGER

This application is a continuation-in-part, of application Ser. No. 342,345, filed 1/25/82, now abandoned.

DESCRIPTION

TECHNICAL FIELD

This invention is in the field of pants or slacks hangers, especially hangers for supporting by one hanger a large number of pants or slacks.

BACKGROUND OF THE INVENTION

Hangers for pants have been known and used for hundreds of years. As presently available commercially, they consist of a single hanger for each pair of pants to be hung. The hanger is usually a pair of cross-bars, extending horizontally, which are clamped together by some type of spring clamping mechanism, with the cuff or bottom end of the pants legs positioned between the clamped together cross-bars. The cross-bars are attached to a supporting hook, so that when the hook is placed over a closet fixture or other support the pants are held upside down, in extended, flat position with the trouser seams straight and aligned and the cloth smooth and flat, thus preventing the formation of wrinkles.

Obviously, these commercially available hangers do an acceptable job; they have been used in large quantities, for many years. But they are not perfect, and they have disadvantages which no one, even over a period of many years, has prior to the present invention been able to obviate, or to overcome through re-design.

For example, if a single hanger that will accept a large number of pants or slacks were made available, in commercially feasible form, it would take up less closet room and could keep an entire set of pants or slacks in one place, which facilitates selection of one pair from among many. Such hangers have been suggested broadly, in the past. See for example, Thorpe U.S. Pat. No. 620,260, issued Feb. 28, 1899 and Glines U.S. Pat. No. 2,287,473, issued June 23, 1942. But the pants of today do not provide the rough cloth and cuffs that were prevalent in 1899, and therefore cannot be relied on for support by wedge action as in the case of hangers such as shown in the Thorpe patent. Nor would they adequately be supported by simple slots as shown in the Glines patent. There exists today a need not only for a commercially feasible multiple pants and slack hanger, so designed as to be simple and inexpensive to manufacture, but also such a hanger that will readily accept and support both cuffed pants as well as cuffless pants, and which will not only accept but will adequately grip and support such pants when made of smooth, thin synthetic fibers, as well as pants made of natural fibers such as wool or cotton.

SUMMARY OF THE INVENTION

According to the present invention, a large number of horizontally extending parallel bars are clamped together, with centrally located spacers therebetween, to provide a series of horizontally extending pants receiving slots on each side of said spacers.

The bars are of rectangular cross-section, and are flat sided. The slots between them are long, extended and bounded on each side by an essentially flat, wide surface of greater length than the width of the pants legs to be inserted therein. Except for a seam relief section cut into the side of each bar in the central portion of its length, each bar has a pants gripping surface which, in conjunction with the pants gripping surface of an opposing bar, is of maximum area, approximately equal to the width of each bar times the length of each bar times two (the gripping area of the opposing bar), less the central relief area. Furthermore, the slots are of equal width, top to bottom, and therefore do not rely on any wedging action of the pants cuffs into the slots for retention purposes.

The bars of the hangers are made from strong, rigid plastic, fiberglass or hardwood, with a relatively high static frictional co-efficient and with the ability to resist binding or distortion. Thus, a pair of pants or slacks is inserted in the slot formed between adjacent bars, such slot being of substantially the same or slightly less thickness than the total thickness of the fabric of the two pants legs (four fabric layers) inserted therein, the frictional force between the inner faces of the adjoining bars and the outer faces of the fabric layers will be sufficiently large as to retain the pants in place in the slot and prevent them from dropping out of the hanger.

It makes no difference whether or not the legs of the pants are provided with cuffs. Cuffs are not relied on for retention of the pants legs in the hanger. If the pants legs have cuffs, they are simply located above the slot between the bars when the pants are slid into the slot. In each case, pants with cuffs or pants without cuffs, the legs of the pants at a point where there are not cuffs are slid into a slot, and in final position, it is only the four layers of fabric forming the two pants legs which lie between, and are frictionally gripped by, the pair of adjoining bars that form the slot.

Because each bar is supported only at its inner end, i.e. fixed at the central part of the hanger but free and unsupported at its outer end, it is in effect a canti-lever, having greater flexibility at its outer end than at its inner end. Therefore each bar is made somewhat thicker at its outer end than at its inner end for the purpose of making the slots between the bars narrower (of less thickness) at their outer ends than at their inner ends. This has the ultimate effect, when pants legs are inserted fully into the slots of tending to equalize the forces exerted by the bars on the fabric of the pants legs gripped between the outer ends of adjoining bars with the forces exerted by the bars on the fabric of the pants legs gripped between the inner ends of said adjoining bars.

Stated another way, the slots between the bars are made narrower (of less thickness) near their free ends than at their fixed ends, in order to prevent the greater flexibility of the free ends from lessening the gripping force of the bars on the pants fabric held therebetween at the free ends of the bars.

The novel multiple pants hanger as above described may be hung on a closet rod by a pair of hooks secured to opposite sides of the hanger, and a bracing strip may be provided to prevent tilting of the hanger about the rod, which could happen if the hanger is unevenly loaded. It also may be fastened by brackets directly to a wall, or a closet door, and thus become a rigid fixture, in position to receive and retain pants for storage in wrinkle free, seam maintaining form until next needed by their owner.

BRIEF DESCRIPTION OF THE DRAWINGS

Referring to the accompanying drawings.

DETAILED DESCRIPTION OF THE DRAWINGS

Figure 1:
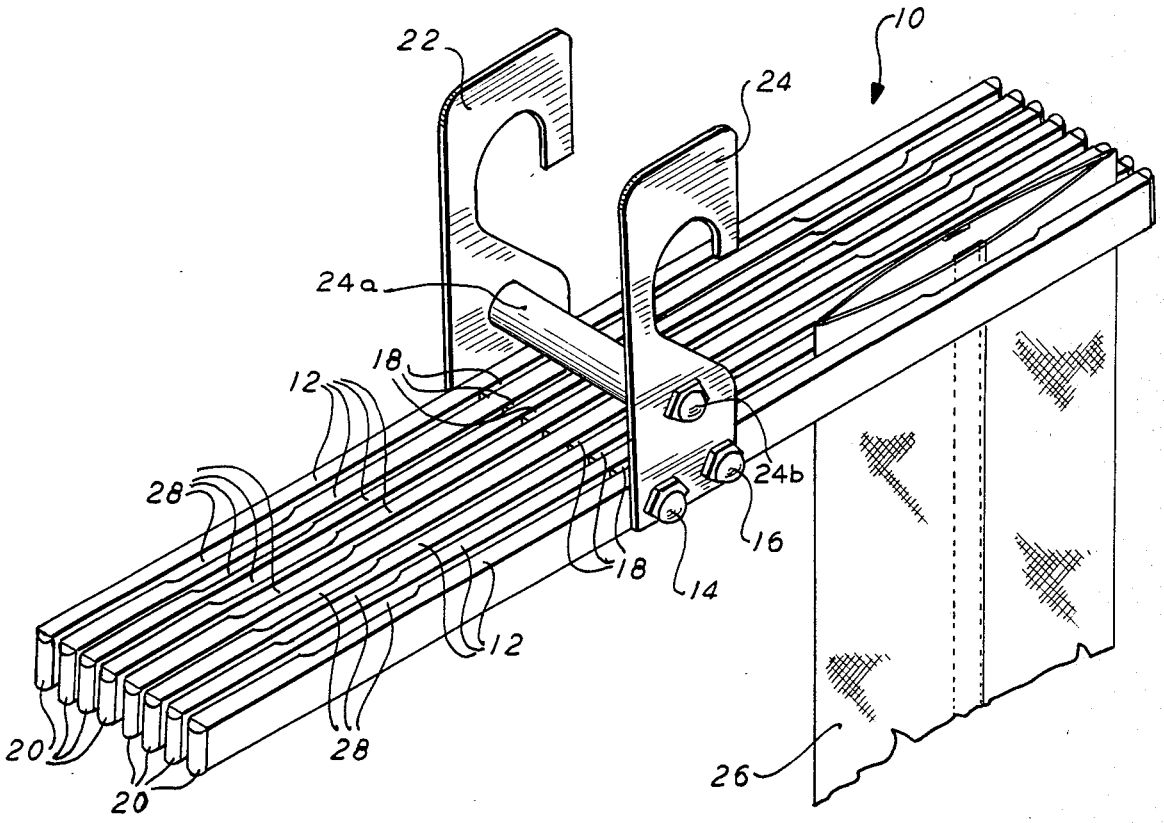
FIG. 1 is a perspective view of a multiple pants hanger constructed according to the present invention, including a portion of a single, seamed, pants leg inserted in one of the pants leg receiving slots of the multiple hanger. A pair of opposed hooks are provided for hanging the hanger of this Figure from a horizontally extending closet supporting rod.
Figure 2:
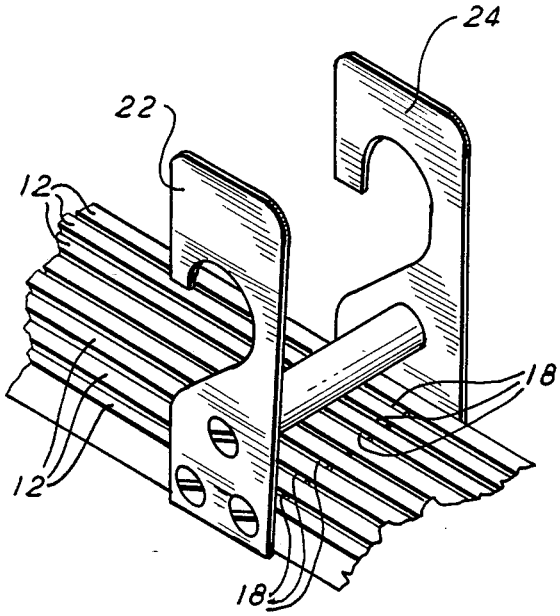
FIG. 2 is sketched, in perspective, which when taken in conjunction with FIGS. 7, 8, and 9, shows how the opposed hook support of FIG. 1 may be slipped into opposing recesses formed by shoulders on a supporting plate adapted to be screwed on an upright wall or door.
Figure 3:
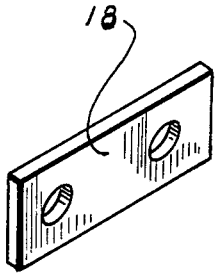
FIG. 3 is a perspective view of one of the bar spacers of FIG. 1.

Referring to FIG. 1 of the drawings, the multiple pants hanger 10 of this invention is made from a series of parallel bars 12,20 clamped together at their central portions by bolts 14,16. Spacers 18 are interposed between the bars so that each bar is spaced horizontally from the next adjacent bar 20 by a slot. These slots extend the entire distance from the spacers which correspond in length to the width of brackets 22, 24 attached to the sides of the hanger by bolts 14, 16 to the outer ends of the hanger, on each side of brackets 22, 24. A wooden handle 24*a* is mounted between brackets 22, 24 by means of bolt 24*b*. Such handle and bolt supports the brackets 22, 24 and provides a convenient handling device for moving the loaded hanger.

A portion of a single pants leg 26 is illustrated in FIG. 1 to show how the slots between bars 20 receive and support a pair of pants or slacks when the hanger is in use. Of course, in actual use, two legs of a single pair of pants would be placed side by side, with the cloth smoothed and free from wrinkles and the leg seams straight, and then both legs of the pants would be slid into one of the slots, and both legs would be supported in the manner illustrated with the single leg in FIG. 1.

The bars 12, 20 are each approximately 22 inches long and the spacers 18 are each approximately two and one-eighth inches long, so that the slots extend inwardly from each end of the hanger for a distance of a little less than ten inches. This distance is sufficient to enable the entire width of a normal pants leg, at its bottom end, to be received in one of the slots, on one side of the spacers 18.

The cross-section of each bar 12, 20 is approximately 0.5 inches wide at their inner ends, adjacent the spacers 18, and 0.530 inches wide, at their outer ends. The depth or thickness of the bar cross-section is approximately 0.625 inches over the entire length of the bar. Both sides of each bar are flat, and adjoining faces are parallel. Thus, the slots between the bars also are of uniform thickness, top to bottom, and the faces of the bars on each side of a slot are fully and completely in frictional contact over their entire surfaces with the fabric of the pants legs retained therebetween.

Because pants legs normally have two seams, one on each side of the crease, running vertically, the thickness of the fabric is greater on each side. The distance to the seams from front to back may vary by as much as two inches. To accomodate this additional thickness and allow full frictional contact between the side face of each bar and the remaining (non-seamed) portions of the pants leg fabric, a portion of the face on one side of each bar is cut-away or removed, at approximately the central portion of its length from its end to the central spacer. This provides an added thickness to each slot at the location of the pants seam when a pair of pants is hung in the hanger and allows the pants to be inserted from either end and properly fit in the hanger. These relieved sections of bars 12, 20 forming recesses on one side of each bar to receive the seamed portions of the pants legs are shown at 28 in FIG. 1. These recesses are on one side only of each bar, with the result that the plane of support of the pants leg is pushed out of a straight line, increasing the supporting force.

It will be seen from the above description that the hanger of this invention does not rely on the wedging of pants cuffs into tapered grooves or against shoulders for support purposes. In fact, the hanger of this invention will support cuffless pants as well as it does cuffed pants. The support which offsets the weight of the pants in the present invention comes from large extensive flat areas of frictional contact between the fabric of the pants and the adjoining faces of the bars; no wedging action, no reliance on cuffs, is required. The factors of design described above provide adequate frictional forces for support, without more.

Figures 4, 5, 6:
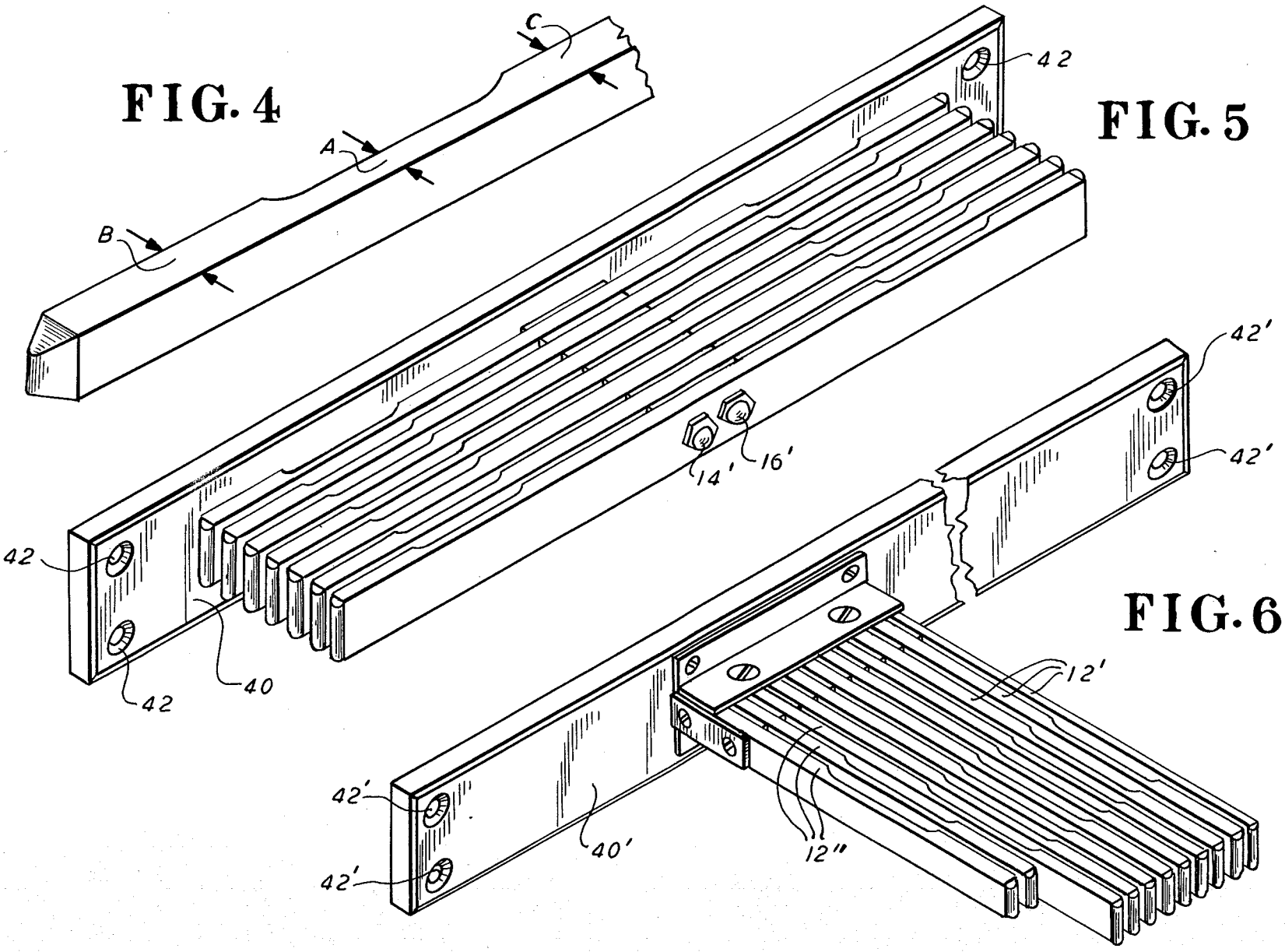
FIG. 4 shows a portion of a single bar of a multiple pants hanger according to the invention, illustrating the variation in bar thickness which results in the selected control of slot thickness, and also showing the central relief portion in one bar of each pair of adjoining bars for accomodating increased thickness of the pants legs at their seams.
FIGS. 5 and 6 are perspectives of two different forms of wall or door supports, for supporting the multiple pants hanger by fastening it directly to a wall or door.

The recesses 28 in one side face of each bar are also shown in FIG. 4. Section "A" of the bar is thinner than the adjacent bar sections "B" and "C" providing additional slot thickness at this location for receiving the thicker portions of the pants legs at the locations of the seams. It should be noted that each end of the recess is leveled (with a 16° angle) thus facilitating entry and exit of the pants legs.

FIG. 4 also shows another feature of the invention which provides full, uniform, frictional contact between the side faces of the bars and the fabric of the pants legs held therebetween. As shown in FIG. 4, the bar thickness on the inside of the recess 28 (toward the central portion of the hanger) is different, shown at "C" , than it is on the outside of the recess 28, shown at "B". The thickness of the bar to the outside of the recess is made greater (0.530 inch) than the thickness of the bar (0.500 inch) to the inside of the recess. Thus the slots between the bars are made narrower (less thick) on the outer sides of the recesses 28 than on the inner sides of the recesses. The ends of the bars are tapered for easy access of pants into the hanger.

This feature takes into account the cantilever action of the bars, supported only at their inner ends. Because the slots are narrower to the outside the adjacent bars must flex a greater distance to accomodate the thickness of the pants legs held therebetween at their outer free ends than they need to flex to accomodate the same thickness at their inner, or central ends. The result is more uniformity in support over the width of the pants legs; with the variation in bar thickness as shown in FIG. 4, the pressure, creating frictional holding force of each side face of each bar on the pants fabric will be more uniform along the entire length of each bar than would otherwise be the case were the bars not made of greater thickness adjacent their outer, free ends. Thus, the supporting forces on each side of the seams of each pants leg are equalized, which tends to keep the seams straight, and to maintain the press.

FIGS. 5 and 6 show two different versions of a wall or door bracket for attaching hangers like the hanger of FIG. 1 to a wall or door. In FIG. 6, one-half of a hanger such as shown in FIG. 1 (i.e only bars 12', extending from one side, not both sides of the central spacers) is attached by plate 40', which in turn is secured to a wall or door by screws received in holes 42'. FIG. 6 also shows how two or more of the bars 12" may be made shorter, if desired, than other bars 12' to receive pants legs of narrow width.

Figure 7:
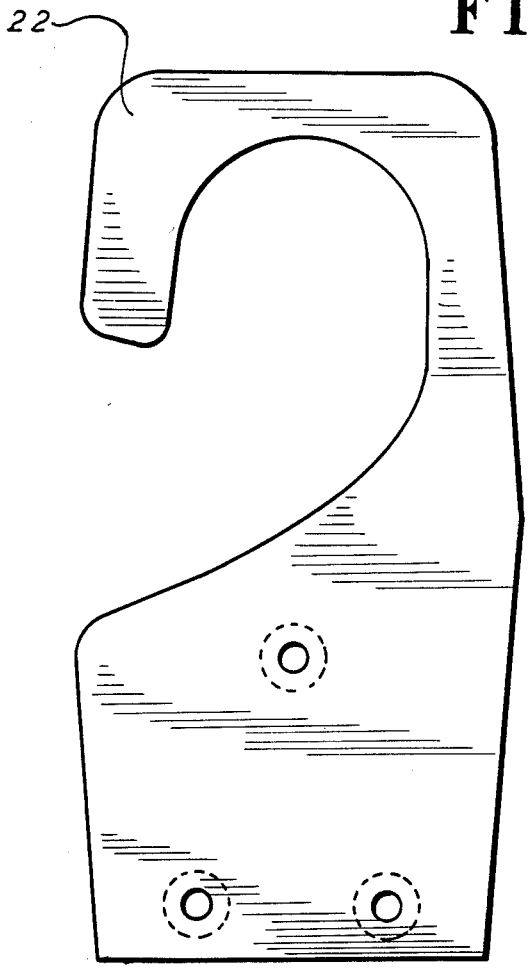
FIG. 7 is a side view of one of the hooks, shown in perspective in FIG. 1, for suspending the pants hanger from a horizontal supporting rod in a closet.
Figure 9:
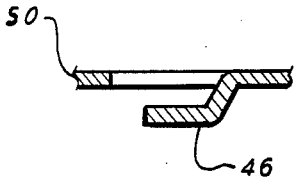
FIG. 9 is a cross-section along the lines 9—9 of FIG. 8.
Figure 8:
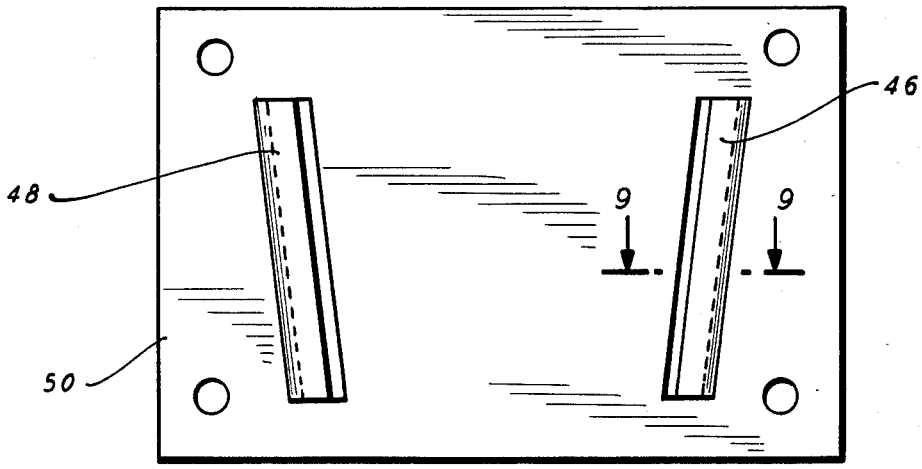
FIG. 8 is a bracket to be fastened by screws to a wall or door and having opposed lugs for detachably receiving a hanger side hook as shown in FIG. 7.

FIGS. 7, 8 & 9 show how other variations of support brackets may be used to mount the hanger, detachably, on a wall or door. The rod hook 22 of FIG. 1 of the hanger may be slipped into a support plate screwed or bolted to the wall or door. Thus the hanger may be detachably secured to the base plate fastened to the wall or door on which the hanger is to be mounted.

The multiple pants hanger of this invention is well adapted to use in commercial displays, as well as for private use in homes. As many as fifty pairs of pants may be supported for display, in a single multiple hanger on each side of the spacers making a total of one hundred pants supported by a single multiple hanger.

I claim:

1. A multiple pants hanger for supporting a plurality of pairs of pants on a clothing bar, comprising a pair of rod hooks, a plurality of horizontally extending parallel bars between said rod hooks and each bar having a rectangular cross-section, and flat vertical faces, spacers located between the bars for spacing the bars apart, said bars being spaced from each other so that pants receiving slots are formed therebetween to hold the pants in an upside down position by uniform pressure on the pants leg across the entire width of the pants leg, each of said slots being of equal width from top to bottom so that each vertical face is fully and completely in frictional contact over the entire vertical surface thereof with the pants leg retained therebetween, means for securing said bars together with the outer end of said bars being free and unconnected so that the slots are open at the outer ends of said bars, each bar being thicker at its outer end than at its inner portion so that said slots between neighboring bars are of less thickness at the outer ends thereof than at the inner ends thereof so as to completely equalize the bearing presssure of the vertical faces formed by a pair of adjacent bars upon the whole portion of the pants inserted in the slot between said faces along the length of said slot, a recess provided on a side of one bar between neighboring bars and between the inner end of the bar and the relatively wider outer end of the bar at a location extending from about the mid-point of the length of the slots to provide for the additional thickness of the seams of a pair of pants retained in one of said slots, the frictional force between the vertical faces of the adjoining bars and the outer faces of the pants legs, being sufficiently large so as to retain the pants in place in the slot and prevent them from dropping out of the hanger, the weight of said pants hanger and the contact of the rod hooks with the clothing bar being sufficient to maintain said hanger in a horizontal position when at rest.

2. The multiple pants hanger according to claim 1 in which the recesses are located approximately at the mid-point of the length of the slots with the length of the recess subdividing the bar in three sections of comparable length with the outer section having the largest thickness, the middle recess section having the smallest thickness and the inner section having an intermediate thickness nearer to the thickness of the outer section.

3. The multiple pants hanger according to claim 1 in which one of said rod hooks is adapted to slide into a bracket attachable to a wall and adapted to a hook at the pants hanger for retaining the pants hanger in a horizontal position adjacent to a wall surface.

4. The multiple pants hanger according to claim 1 wherein each of said rod hooks include a plate shaped part positioned against one of the outer horizontal bars and including three holes with two lower holes provided for bolting the plate shaped parts and the horizontal bars together and with a third hole for a spacer to be located between the plate parts to provide three-dimensional spacial stability of the relative position of the two rod hooks with the hooks disposed such that a motion in a direction about parallel to the plane of the plate parts results in an engagement of a rod hook with a respective rod.

* * * * *